US005116089A

United States Patent [19]

Taylor

[11] Patent Number: 5,116,089

[45] Date of Patent: May 26, 1992

[54] EXPLOSION VENT DOOR RELEASE

[76] Inventor: Julian S. Taylor, 8300 SW. 8th, Oklahoma City, Okla. 73128

[21] Appl. No.: 695,668

[22] Filed: May 6, 1991

[51] Int. Cl.[5] ..... E05C 3/02

[52] U.S. Cl. ..... 292/78; 292/DIG. 65; 292/229

[58] Field of Search ..... 292/DIG. 65, 78, 229, 292/341.15, DIG. 44, DIG. 66; 52/98

[56] References Cited

U.S. PATENT DOCUMENTS

| | | | |
|---|---|---|---|
| 2,288,145 | 6/1942 | Siegfus | 292/DIG. 49 X |
| 3,338,612 | 8/1967 | Howard | 292/DIG. 44 X |
| 4,067,154 | 1/1978 | Fike, Jr. | 52/99 |
| 4,099,754 | 7/1978 | Haebing | 292/DIG. 65 X |
| 4,230,352 | 10/1980 | Sealey et al. | 292/DIG. 65 X |
| 4,539,929 | 9/1985 | Sestak et al. | 292/DIG. 66 |
| 4,547,008 | 10/1985 | Takasaki | 292/341.15 |
| 4,899,960 | 2/1990 | Hararad-Tehrani et al. | 52/98 X |

*Primary Examiner*—Richard E. Moore
*Attorney, Agent, or Firm*—Robert K. Rhea

[57] ABSTRACT

An explosion vent installation for a closed space comprising a door swingably mounted for outward movement. An elongated pressure collapsible pin is supported at one end, by an arm end portion overlying the door edge portion opposite its hinges and in the direction of the door opening movement. The other end of the arm is pivotally connected with a pin supported body mounted on a door jam. The pin is supported at its other end by a pin support bolt in the pin support body. The arm is moved in a pin collapsing direction by the door opening in response to excess pressure above a predetermined value in the space monitored.

3 Claims, 1 Drawing Sheet

EXPLOSION VENT DOOR RELEASE

BACKGROUND OF THE INVENTION

1. Field of the Invention

This invention relates to explosion vent openings for industrial storage and process buildings.

Industries, utilizing dust and vapor handling equipment, are faced with a continuous explosion potential.

Dust and vapor explosions are the result of rapid release of energy generated virtually instantaneously. This occurs either by rapid oxidation or by the development of internal pressure beyond the confinement capability of the enclosure causing it to rapidly and fully open.

Explosion venting is a protective measure of explosion pressure relief. Venting is intended to prevent the destruction of an enclosure due to an over pressured condition caused by dust or vapor explosion. It is also a protection measure to prevent the exploding of an enclosure due to other resultant over pressured caused by mechanical system failures.

2. Description of the Prior Art

There are explosive vents on the market based on rupture disc panels, such as is disclosed by U.S. Pat. No. 4,067,154. This patent depends upon the breading of a membrane or panel to form a vent opening. A rupture membrane has several disadvantages, such as: replacing a membrane approximately 3 ft.×4 ft. would cost approximately $800.00; also, the accuracy of a membrane rupturing is extremely limited and when ruptured, does not fully tear; the accuracy of a breaking membrane system is extremely low, being rated as having an accuracy of plus or minus one-half of one psi with a standard opening pressure of between 1 to 4 psi above atmospheric pressure; and, another disadvantage of a membrane is that is must operate within 50% of the actual burst pressure for the reason a membrane is subject to fatigue and if it does operate near its bursting pressure, it will always burst prematurely.

Other latch devices are available for door type venting such as a latch utilizing a spring loaded cam presently marketed by the Brixon Manufacturing Company of St. Paul, Minn. 55114. However, this particular latch requires constant maintenance and is subject to corrosive action and lacks the accuracy desired in a vent door explosion release apparatus.

This invention obviates the above disadvantages by providing a collapsible or pressure release rupture pin collapsed by axially applied pressure which permits accurate calibration of its failure value. Further, replacement cost of the rupture pin approximates $10.00. Also, a rupture pin release explosion vent door prevents the door to fully open and therefore provides a greater venting volume of explosion gases.

SUMMARY OF THE INVENTION

A rupture pin supporting base is flatly mounted on the face of a door jamb adjacent its edge, opposite the door hinge mounting and supports an outstanding channel-shaped body portion connected to the base by its legs.

The bight portion of the body is apertured and threaded for receiving a stud bolt nesting one end portion of a collapsible pin having its other end portion nested by a socket in a boss mounted on an arm overlying the adjacent edge of a door being monitored. The other end of the arm is pivotally connected between the body legs by a transverse shaft.

An adjusting screw in the end portion of the arm overlying the door maintains contact between the arm and a door plate mounted on the adjacent edge of the door.

A resilient spring normally biases the pin mounting arm toward a retracted position when the pin collapses and when the device is not armed.

The principal object of this invention is to provide an economical pressure responsive release apparatus for releasing an explosion force vent door to a fully open position in the event of excess pressure above a predetermined limit in a space being monitored which is accurate in its pressure setting release value.

DESCRIPTION OF THE PREFERRED EMBODIMENTS

Figure 1:
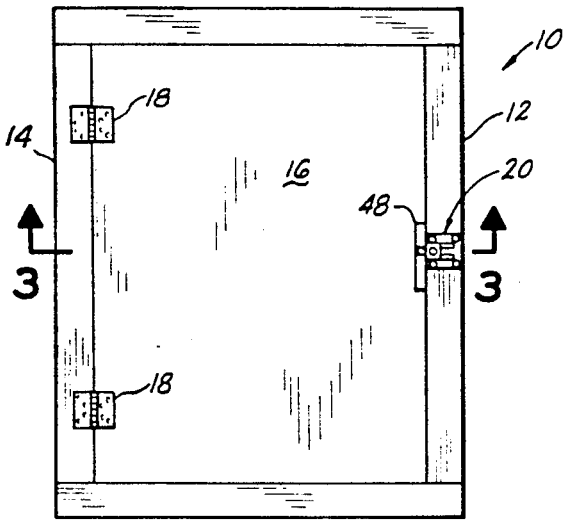
FIG. 1 is an elevational view of an explosion vent door mounted in a surrounding door frame with the pressure release device installed thereon.
Figure 4:
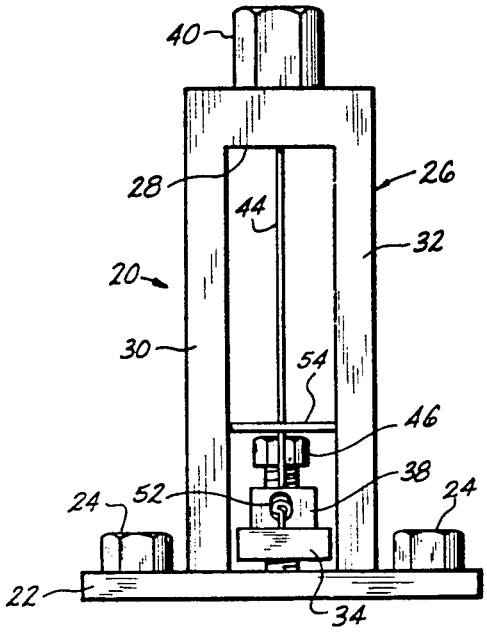
Figure 2:
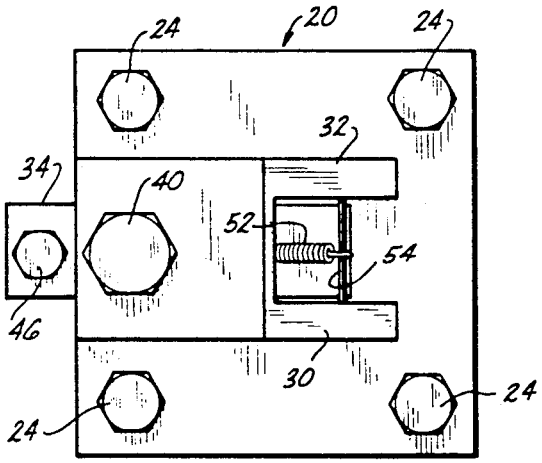
FIG. 2 is a top plan view of the device, per se, to an enlarged scale.

Like characters of reference designate like parts in those figures of the drawings in which they occur.

In the drawings:

The reference numeral 10 indicates a door frame including vertical door jambs 12 and 14 within which a planar door 16 is hingedly mounted, by hinge means 18, to the door jamb 14. The door frame 10 is adapted to fill a cooperative opening in a wall, not shown, enclosing a space or area to be explosion vented.

Rupture pin means 20 normally maintains the door in closed position. The rupture pin means 20 is preferably mounted midway the height of the door 16 on the face of the door jamb 12 in the direction of door opening movement and adjacent its edge opposite the hinge means 18.

The pin means 20 comprises a base 22 flatly mounted on the door jamb 12 adjacent its longitudinal edge facing the door by screw threaded fasteners 24.

The pin means 20 further comprises an inverted U-shaped body 26 having a flat bight portion 28 disposed in parallel outstanding relation with respect to the base 22 and rigidly connected centrally thereto by its elongated legs 30 and 32 with the planes of the legs normal to the plane of the adjacent face of the door.

A pin supporting arm 34 is pivotally supported by a shaft 36 extending transversely between the body legs 30 and 32 adjacent the surface of the pin base 22. The arm 34 projects between the legs beyond the door edge of the base 22 a selected distance to overlie the adjacent edge portion of the door. The arm is provided with a pin holding boss 38 having a pin end nesting socket 39 open toward the body bight 28.

The bight 28 is drilled and threaded in axial alignment with the socket 39 for receiving a pin retaining stud bolt 40 having its shaft end centrally provided with a socket 42 which nests the other end portion of a collapsible pin 44.

The end portion of the arm 34 remote from its hinge pin 36 is provided with a lock nut-equipped stud bolt 46 in contact with a door plate 48 mounted on the surface of the door facing the direction of its opening, indicated by the arrow 50, to maintain positive contact between the door plate 48 and the pin supporting arm 34.

A resilient member, such as a spring 52 connected at one end with the arm 34 is connected at its other end with a spring pin 54 transversely extending between the body legs 30 and 32 for the purpose presently explained.

OPERATION

Figure 3:
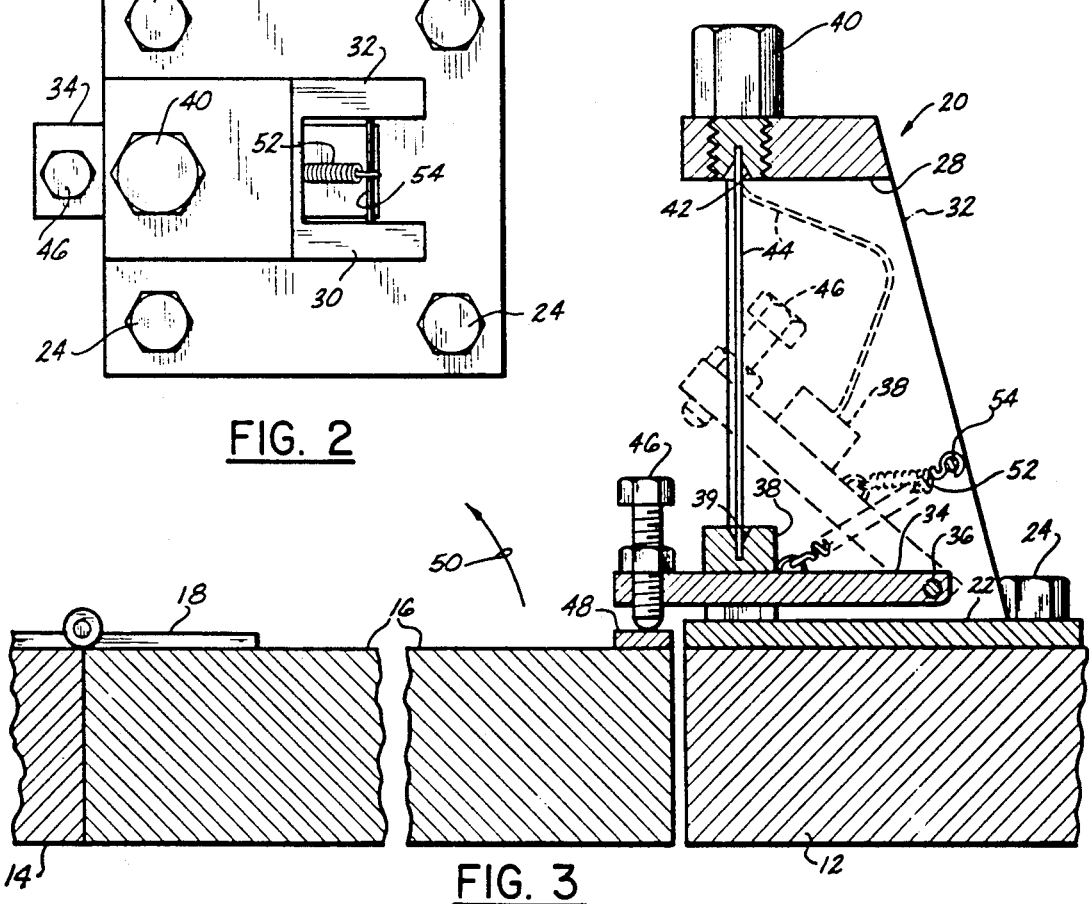
FIG. 3 is a fragmentary horizontal cross sectional view to a different scale, taken substantially along the line 3—3 of FIG. 1 and illustrating by broken lines the pin in collapsed position; and, FIG. 4 is a right side elevational view of the device, per se, as viewed in FIG. 3 with the arm retracting spring broken away for clarity.

Assuming the device 20 has been installed on the door 16 in the wall of a space to be explosion vented as described hereinabove. In the event of excessive pressure above atmospheric a predetermined limit the collapsible pin 44 bends in a lateral direction (FIG. 3) thus releasing the door 16 for opening pivoting movement in the direction of the arrow 50. During collapse of the pin 44 the lock nut bolt end portion of the arm 34 pivots away from the door jamb 12 about the axis of its hinge shaft 36. This releases the door 16 for full opening movement thereof and rapid venting of the explosive force. When the device 20 is not armed for explosive pressure release the spring 52 maintains the pin support arm 34 in a retracted position near its broken line position of FIG. 3.

When the device is to be rearmed, the arm 34 is manually pivoted to its solid line position (FIG. 3), the pin retaining bolt 40 is loosened to receive a new pin 44 inserted at its ends into the arm and bolt sockets 39 and 40, respectively. While manually holding the pin 44, the retaining bolt 40 is tightened to reposition the pin means components as previously described.

It is believed obvious that the door 16 could be mounted to swing open in either direction by using a piano hinge instead of the illustrated butt hinges and mounting a duplicate collapsible pin release means, not shown, on the wall side opposite the door jamb 12.

Obviously the invention is susceptible to changes or alterations without defeating its practicability. Therefore, I do not wish to be confined to the preferred embodiment shown in the drawings and described herein.

I claim:

1. A pressure release apparatus for a door hingedly mounted between door jambs and normally closing a vent opening of a chamber or area subject to dangerously elevated internal pressure, comprising:

a base member mounted on the door jamb adjacent the door edge opposite its hinge mounting;

a pin support body means rigidly secured to said base member and having a portion overhanging said base;

arm means having one end portion overlying an edge portion of said door and secured, at its other end portion, to said body means for pivoting movement of said one end portion toward and away from said door edge portion;

an elongated collapsible pin axially extending between the arm means said one end portion and the body means overhanging portion for normally maintaining said door in closed position; and, first and second pin end support means each having a socket axially aligned with the other, said first support means supported by said arm one end portion and, said second support means supported by the body overhanging portion for supporting respective end portions of said pin.

2. The pressure release apparatus according to claim 1 and further including:

set screw means on said arm means for normally maintaining contact between said arm means and said door edge portion.

3. The pressure release apparatus according to claim 2 and further including:

resilient means interposed between said arm means and said body for biasing said arm means one end portion out of the path of door opening movement.

* * * * *